US010301566B2

(12) United States Patent
Gunawan

(10) Patent No.: US 10,301,566 B2
(45) Date of Patent: May 28, 2019

(54) FUEL COMPOSITION

(71) Applicant: Chevron U.S.A. Inc., San Ramon, CA (US)

(72) Inventor: Theresa Liang Gunawan, Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 15/281,515

(22) Filed: Sep. 30, 2016

(65) Prior Publication Data

US 2018/0094203 A1 Apr. 5, 2018

(51) Int. Cl.

| | |
|---|---|
| ***C10L 1/18*** | (2006.01) |
| ***C10L 1/19*** | (2006.01) |
| ***C10L 10/08*** | (2006.01) |
| ***C10L 10/14*** | (2006.01) |
| ***C10L 1/22*** | (2006.01) |
| *C10L 1/182* | (2006.01) |
| *C10L 1/222* | (2006.01) |

(52) U.S. Cl.

CPC ..... *C10L 10/14* (2013.01); *C10L 1/18* (2013.01); *C10L 1/22* (2013.01); *C10L 10/08* (2013.01); *C10L 1/1824* (2013.01); *C10L 1/19* (2013.01); *C10L 1/191* (2013.01); *C10L 1/2222* (2013.01); *C10L 2200/0259* (2013.01); *C10L 2200/0423* (2013.01); *C10L 2230/14* (2013.01); *C10L 2270/023* (2013.01); *C10L 2300/20* (2013.01)

(58) Field of Classification Search

CPC ..... C10M 129/76; C10L 1/19; C10L 10/08; C10L 10/14; C10L 10/18; C10L 1/1824; C10L 1/191; C10L 1/22; C10L 1/2222; C10L 2200/0259; C10L 2200/0423; C10L 2230/14; C10L 2270/023; C10L 2300/20

See application file for complete search history.

(56) References Cited

U.S. PATENT DOCUMENTS

| | | | | |
|---|---|---|---|---|
| 2003/0186824 | A1* | 10/2003 | Chiu | C10M 101/04 508/490 |
| 2009/0054281 | A1* | 2/2009 | Oldfield | C10L 1/1983 508/465 |
| 2010/0210487 | A1 | 8/2010 | Deblase et al. | |
| 2011/0162263 | A1* | 7/2011 | Vilardo | C10L 10/14 44/389 |
| 2015/0166922 | A1* | 6/2015 | DeBlase | C10M 129/76 508/100 |

* cited by examiner

*Primary Examiner* — Latosha Hines

(74) *Attorney, Agent, or Firm* — Ryan, Mason & Lewis, LLP

(57) ABSTRACT

Disclosed herein is a fuel additive comprising a mixture of (a) one or more fatty acid sorbitan esters and (b) one or more fatty acid monoesters of a polyol, wherein the one or more fatty acid sorbitan esters are present in an amount of about 0.05 wt. % to about 50 wt. %, based on the weight of the fuel additive, and the one or more fatty acid monoesters of a polyol are present in an amount of about 99.95 wt. % to about 50 wt. %, based on the weight of the fuel additive. Also disclosed is a fuel composition comprising a major amount of a fuel and minor amount of the fuel additive.

18 Claims, No Drawings

FUEL COMPOSITION

BACKGROUND OF THE INVENTION

1. Technical Field

The present invention relates generally to a friction modifier mixture containing a sorbitan ester and one or more fatty acid monoesters of a polyol glycerol monoester for use in fuels, especially in gasolines for internal combustion engines.

2. Description of the Related Art

Fuel compositions for vehicles are continually being improved to enhance various properties of the fuels in order to accommodate their use in newer, more advanced engines including direct injection gasoline engines. Accordingly, fuel compositions typically include additives that are directed to certain properties that require improvement. For example, friction modifiers, such as partial esters of fatty acid and polyols, are added to fuel to reduce friction and wear in the fuel delivery systems of an engine.

Current practice in the supply of gasoline is generally to pre-mix the fuel additives into a concentrate in a hydrocarbon solvent base, and then to inject the concentrate from an additives tank into a set amount of base gasoline via pipelines to fill tankers prior to delivery to the customer. To facilitate injection of the concentrate, especially in the correct component ratios of the concentrate package, into the gasoline, it is important that the concentrate is in the form of a low viscosity, homogeneous liquid. Problems have been encountered in achieving a stable concentrate due to the poor solubility of conventional friction modifiers, especially at low temperatures. In particular, the partial esters of fatty acid and polyols such as glycerol monooleate (GMO) are known friction modifiers for lubricant compositions. While partial esters of fatty acid and polyols such as GMO friction modifiers may improve fuel economy when added to a lubricant, the partial esters of fatty acid and polyols are unstable in additive packages for fuels at low storage temperatures or in use in cold regions making them difficult to handle in the field. In particular, due to the fatty and sometimes waxy nature of the fatty acids and their derivatives, concentrated additive packages containing such materials tend to have poor low temperature stability properties. This poor low temperature stability is seen in the formation of solids, sediments and/or thick gels in the additive packages containing these materials thereby resulting in poor handling characteristics of packages containing these additives, especially in northern and/or cooler climates where the packages may be regularly exposed to cooler temperatures.

The solubility of the friction modifier in the additive packages at low temperatures may be assisted by employing solubilizing agents. However, the amount of solubilizing agent required to solubilize the desired level of friction modifier in the concentrate often exceeds the maximum amount possible given the constraints on the amount of concentrate that can be injected into the gasoline, and the amount of solubilizing agent that can be contained in the concentrate. In addition, some solubilizing agents tend to alter the properties of the friction modifier, to be reactive with contaminants or chemical components resulting from refinery processes used in the production of base gasoline, or other additives contained in the concentrate, causing chemical degradation and/or a reduction in performance in the resulting gasoline composition.

Accordingly, there is a need for an improved friction modifier additive and/or concentrate for fuels such as gasoline containing partial esters of fatty acids and polyols that provides friction reduction while being stable over the temperature range at which the concentrate may feasibly be stored, or used in low temperature regions and which does not adversely affect the performance and properties of the finished fuel or engine in which the fuel is used.

SUMMARY OF THE INVENTION

In accordance with one embodiment of the present invention, there is provided a fuel additive comprising a mixture of (a) one or more fatty acid sorbitan esters and (b) one or more fatty acid monoesters of a polyol, wherein the mixture contains one or more fatty acid sorbitan esters present in an amount of about 0.05 wt. % to about 50 wt. %, based on the total weight of the fuel additive, and the one or more fatty acid monoesters of a polyol present in an amount of about 99.95 wt. % to about 50 wt. %, based on the total weight of the fuel additive.

In accordance with a second embodiment of the present invention, there is provided a fuel additive concentrate comprising from about 5 wt. % to about 75 wt. % of (a) a fuel additive comprising a mixture of (i) one or more fatty acid sorbitan esters and (ii) one or more fatty acid monoesters of a polyol, wherein the one or more fatty acid sorbitan esters are present in an amount of about 0.05 wt. % to about 50 wt. %, based on the total weight of the fuel additive, and the one or more fatty acid monoesters of a polyol present in an amount of about 99.95 wt. % to about 50 wt. %, based on the total weight of the fuel additive, (b) about 10 wt. % to about 95 wt. % of a fuel carrier fluid.

In accordance with a third embodiment of the present invention, there is provided a fuel composition comprising (a) a major amount of a fuel, and (b) a minor amount of a fuel additive comprising a mixture of (i) one or more fatty acid sorbitan esters and (ii) one or more fatty acid monoesters of a polyol, wherein the one or more fatty acid sorbitan esters are present in an amount of about 0.05 wt. % to about 50 wt. %, based on the total weight of the fuel additive, and the one or more fatty acid monoesters of a polyol present in an amount of about 99.95 wt. % to about 50 wt. %, based on the total weight of the fuel additive.

In accordance with a fourth embodiment of the present invention, there is provided a fuel composition comprising (a) a major amount of a fuel, and (b) a minor amount of a fuel additive concentrate comprising from about 5 wt. % to about 75 wt. % of (i) a fuel additive comprising a mixture of one or more fatty acid sorbitan esters and one or more fatty acid monoesters of a polyol, wherein the one or more fatty acid sorbitan esters are present in an amount of about 0.05 wt. % to about 50 wt. %, based on the total weight of the fuel additive, and the one or more fatty acid monoesters of a polyol present in an amount of about 99.95 wt. % to about 50 wt. %, based on the total weight of the fuel additive, and (ii) about 10 to about 95 wt. % of a fuel carrier fluid.

In accordance with a fifth embodiment of the present invention, there is provided a method to improve the low temperature stability of one or more fatty acid monoesters of a polyol in a fuel composition, the method comprising (a) providing a fuel additive comprising a mixture of (i) one or more fatty acid sorbitan esters and (ii) one or more fatty acid monoesters of a polyol, wherein the one or more fatty acid sorbitan esters are present in an amount of about 0.05 wt. % to about 50 wt. %, based on the total weight of the fuel additive, and the one or more fatty acid monoesters of a polyol present in an amount of about 99.95 wt. % to about 50 wt. %, based on the total weight of the fuel additive, and (b) combining the fuel additive with a major amount of a fuel.

In accordance with a sixth embodiment of the present invention, there is provided a method comprising operating an internal combustion engine with a fuel composition comprising (a) a major amount of a fuel, and (b) a minor amount of a fuel additive comprising a mixture of (i) one or more fatty acid sorbitan esters and (ii) one or more fatty acid monoesters of a polyol, wherein the one or more fatty acid sorbitan esters are present in an amount of about 0.05 wt. % to about 50 wt. %, based on the total weight of the fuel additive, and the one or more fatty acid monoesters of a polyol present in an amount of about 99.95 wt. % to about 50 wt. %, based on the total weight of the fuel additive.

In accordance with a seventh embodiment of the present invention, there is provided a use of one or more fatty acid sorbitan esters in a fuel additive comprising one or more fatty acid monoesters of a polyol, wherein the one or more fatty acid sorbitan esters are present in an amount of about 0.05 wt. % to about 50 wt. %, based on the total weight of the fuel additive, and the one or more fatty acid monoesters of a polyol present in an amount of about 99.95 wt. % to about 50 wt. %, based on the total weight of the fuel additive, for the purpose of improving the low temperature stability of the one or more fatty acid monoesters of a polyol in a fuel composition.

The present invention is based on the surprising discovery that by forming a fuel additive comprising a mixture of one or more fatty acid sorbitan esters and one or more fatty acid monoesters of a polyol, wherein the one or more fatty acid sorbitan esters are present in an amount of about 0.05 wt. % to about 50 wt. %, based on the total weight of the fuel additive, and the one or more fatty acid monoesters of a polyol present in an amount of about 99.95 wt. % to about 50 wt. %, based on the total weight of the fuel additive, which allows the one or more fatty acid monoesters of a polyol to advantageously have low temperature stability in the fuel additive when stores in a fuel additive concentrate at low temperatures, e.g., lack of formation of sediment, cloudiness, etc. Accordingly, the fatty acid sorbitan esters are able to act as anti-crystallization or anti-sedimentation agents for the fatty acid monoesters of a polyol in low temperature environments, i.e., cold climates, without detriment to the friction modifying properties of the fuel additive. Thus, the fuel additive is able to have improved low temperature compatibility in a fuel composition when used in a low temperature environment.

DETAILED DESCRIPTION OF THE PREFERRED EMBODIMENTS

In one embodiment, a fuel additive is provided which comprises a mixture of one or more fatty acid sorbitan esters and one or more fatty acid monoesters of a polyol, wherein the one or more fatty acid sorbitan esters are present in an amount of about 0.05 wt. % to about 50 wt. %, based on the total weight of the fuel additive, and the one or more fatty acid monoesters of a polyol present in an amount of about 99.95 wt. % to about 50 wt. %, based on the total weight of the fuel additive.

The one or more fatty acid sorbitan esters for use in the fuel additive of the present invention are obtained by subjecting a fatty acid to ester bonding (i.e., esterification) with one or more of the OH groups of sorbitan. Alternatively, the one or more fatty acid sorbitan esters are commercially available from such sources as, for example, Santa Cruz Biotechnology, Inc., Sigma-Aldrich, and Alfa Aesar. As one skilled in the art will readily understand, sorbitan esters can be mono-, di-, tri- and/or tetraesters. In the present invention, the fatty acid moiety of the fatty acid sorbitan esters has from about 4 to about 28 carbon atoms, or from about 6 to about 24 carbon atoms, or from about 8 to about 22 carbon atoms, or from about 10 to about 18 carbon atoms, or from about 12 to about 18 carbon atoms or from about 16 to about 18 carbon atoms.

Fatty acids are a class of compounds containing a long hydrocarbon chain and a terminal carboxylate group and are characterized as unsaturated or saturated depending upon whether a double bond is present in the hydrocarbon chain. Therefore, an unsaturated fatty acid has at least one double bond in its hydrocarbon chain whereas a saturated fatty acid has no double bonds in its fatty acid chain. Representative examples of unsaturated fatty acids include, but are not limited to, myristoleic acid, palmitoleic acid, oleic acid, linolenic acid, and the like. Representative examples of saturated fatty acids include, but are not limited to, caproic acid, caprylic acid, capric acid, lauric acid, myristic acid, palmitic acid, stearic acid, arachidic acid, behenic acid, lignoceric acid, and the like. In one embodiment, the fatty acid (and the resulting fatty acid sorbitan ester composition of the invention) comprises a mixture of fully saturated fatty acids and partially unsaturated fatty acids. In other embodiments, such fatty acids may be substituted at any one or more of the carbons. The substituents may include, for example, one or more alkyl, aryl, acyl, alkoxy and/or branched alkyl(iso-stearic) groups.

Representative examples of suitable fatty acid sorbitan esters include, but are not limited to, sorbitan monolaurate, sorbitan monopalmitate, sorbitan monostearate, sorbitan monoisostearate, sorbitan monooleate, sorbitan monolinoleate, sorbitan dilaurate, sorbitan dipalmitate, sorbitan distearate, sorbitan diisostearate, sorbitan dioleate, sorbitan dilinoleate, sorbitan lauryl palmityl diester, sorbitan lauryl stearyl diester, sorbitan lauryl isostearyl diester, sorbitan lauryl oleyl diester, sorbitan lauryl linoleyl diester, sorbitan palmityl stearyl diester, sorbitan palmityl isostearyl diester, sorbitan palmityl oleyl diester, sorbitan palmityl linoleyl diester, sorbitan stearyl isostearyl diester, sorbitan stearyl oleyl diester, sorbitan stearyl linoleyl diester, sorbitan isostearyl oleyl diester, sorbitan isostearyl linoleyl diester, sorbitan trilaurate, sorbitan tripalmitate, sorbitan tristearate, sorbitan triisostearate, sorbitan trioleate, sorbitan trilinoleate, sorbitan tetralaurate, sorbitan tetrapalmitate, sorbitan tetrastearate, sorbitan tetraisostearate, sorbitan tetraoleate, sorbitan tetralinoleate, sorbitan sesquioleate and mixtures thereof and the like. In one embodiment, the fatty acid sorbitan ester comprises a mixture of several fatty acid sorbitan esters.

The fatty acid sorbitan ester is present in the mixture of the fuel additive of the present invention in an amount of about 0.05 wt. % to about 50 wt. %, based on the total weight of the fuel additive. In one embodiment, the fatty acid sorbitan ester is present in the mixture of the fuel additive of the present invention in an amount of about 0.1 wt. % to about 50 wt. %, based on the total weight of the fuel additive. In one embodiment, the fatty acid sorbitan ester is present in the mixture of the fuel additive of the present invention in an amount of about 0.1 wt. % to about 1 wt. %, based on the total weight of the fuel additive.

The fuel additive of the present invention will further contain one or more fatty acid monoesters of a polyol. In general, the fatty acid monoester of a polyol is obtained by subjecting a fatty acid to ester bonding (i.e., esterification) with one of the OH groups present in the polyol, e.g., in the case of glycerol as the polyol, it is classified as a glycerol fatty acid monoester. As one skilled in the art will readily appreciate, a fatty acid monoester of a polyol may be as is or as a mixture containing minor amounts of a diester and/or triester. In the present invention, the fatty acid moiety of the fatty acid monoester has from about 4 to about 28 carbon atoms, or from about 6 to about 24 carbon atoms, or from about 8 to about 22 carbon atoms, or from about 10 to about 18 carbon atoms, or from about 12 to about 18 carbon atoms or from about 16 to about 18 carbon atoms.

The fatty acids can be unsaturated or saturated, linear or branched. Therefore, an unsaturated fatty acid has at least one double bond in its hydrocarbon chain whereas a saturated fatty acid has no double bonds in its fatty acid chain. Representative examples of unsaturated fatty acids include, but are not limited to, myristoleic acid, palmitoleic acid, oleic acid, linoleic acid, linolenic acid, and the like. Representative examples of saturated fatty acids include, but are not limited to, caproic acid, caprylic acid, capric acid, lauric acid, myristic acid, palmitic acid, stearic acid, isostearic acid, arachidic acid, behenic acid, lignoceric acid, and the like.

Useful polyols include those polyols containing from two to about 10 carbon atoms and from two to six hydroxyl groups or from two to four hydroxyl groups. Non-limiting examples include, but are not limited to, 1,2-propanediol, 1,3-propanediol, glycerol, 1,2-butanediol, 1,3-butanediol, 2,3-butanediol, 2-ethyl-1,3-propanediol, 2-ethyl-2-butyl-1,3-propanediol, neopentyl glycol, 2,2,4-trimethyl-1,3-pentanediol, trimethylolpropane (TMP), pentaerythritol and the like and combinations thereof.

In one embodiment, the fatty acid monoesters which may be employed include, but are not limited to, glycerol monolaurate, glycerol monostearate, glycerol monoisostearate, glycerol monopalmitate, glycerol monooleate, glycerol monolinoleate, pentaerythritol monostearate, pentaerythritol monolaurate, pentaerythritol monoisostearate, pentaerythritol monooleate, pentaerythritol monolinoleate, and the like.

In general, the one or more fatty acid monoesters of a polyol will be present in the mixture of the fuel additive of the present invention in an amount ranging from about 50 wt. % to about 99.95 wt. %, based on the total weight of the fuel additive. In another embodiment, the one or more fatty acid monoesters of a polyol will be present in the mixture of the fuel additive of the present invention in an amount ranging from about 50 wt. % to about 99.90 wt. %, based on the total weight of the fuel additive. In another embodiment, the one or more fatty acid monoesters of a polyol will be present in the mixture of the fuel additive of the present invention in an amount ranging from about 99.00 wt. % to about 99.95 wt. %, based on the total weight of the fuel additive.

In one embodiment, the foregoing fuel additive is present in a fuel additive concentrate. In general, the amount of the fuel additive contained in the fuel additive concentrate is from about 5 to about 75 wt. %, about 5 to about 50 wt. %, or from about 5 to about 45 wt. %, or from about 5 to about 40 wt. %, based on the total weight of the fuel additive concentrate. In one embodiment, the amount of the fuel additive contained in the fuel additive concentrate is from about 5 wt. % to about 30 wt. %, based on the total weight of the fuel additive concentrate.

The fuel carrier fluid may be any suitable carrier fluid that is compatible with the gasoline and is capable of dissolving or dispersing the components of the additive package. Typically it is a hydrocarbon fluid, for example a petroleum or synthetic lubricating oil basestock including mineral oil, synthetic oils such as esters or polyesters or polyethers or other polyols, or hydrocracked or hydroisomerized basestock. Alternatively the fuel carrier fluid may be a distillate boiling in the gasoline range. The amount of carrier fluid contained in the fuel additive concentrate is from about 10 to about 95 wt. %, or from about 20 to about 80 wt. %, or from about 30 to about 70 wt. %, based on the total weight of the fuel additive concentrate. In one embodiment, the amount of carrier fluid contained in the fuel additive concentrate is from about 50 to about 95 wt. %, based on the total weight of the fuel additive concentrate.

In one embodiment, a suitable solvent can be added to fuel additive concentrate to assist in preventing crystallization of the additive package at a low temperature environment. A suitable solvent is a low molecular weight alcohol such as a $C_1$ to $C_{12}$ alcohol. Representative examples include, but are not limited to, methanol, ethanol, isopropanol, butanol, 2-ethylhexanol, and the like. Generally the amount of solvent employed is up to about 50 wt % based on the total weight of the additive concentrate, for example, from 0 to 30 wt. % or from 5 to 30 wt. %. In one embodiment, no solvent is used in the fuel additive concentrate.

In accordance with one embodiment, the fuel additive concentrate in accordance with the present invention will have a kinematic viscosity at −18° C., ranging from about 50 to about 1000 $mm^2/s$ as determined by ASTM D445.

In accordance with one embodiment, the fuel additive concentrate in accordance with the present invention will have a kinematic viscosity at 40° C., ranging from about 5 to about 100 $mm^2/s$ as determined by ASTM D445.

Once the fuel additive concentrate is obtained, it is then stored in, e.g., a tank or tanker, in a low temperature environment prior to being used in a fuel. For example, the fuel is stored in a cold climate region, e.g., a region having temperatures below freezing, such as from about 0° C. and below, or from about −5° C. and below, or from about −20° C. and below. In one embodiment, the fuel additive concentrate is stored at a temperature below about 0° C. for a time period up to about 14 days. In one embodiment, the fuel additive concentrate is stored at a temperature of about −5° C. and below for a time period up to about 11 days. In one embodiment, the fuel additive concentrate is stored at a temperature from about 0° C. down to about −5° C. for a time period up to about 30 days, e.g., from about 10 days up about 30 days. In one embodiment, the fuel additive concentrate is stored at a temperature of about −5° C. and below for a time period up to about 28 days.

The fuel additive concentrate is then incorporated into the gasoline or other fuel by, for example, injection. However, any suitable method of incorporation may be used. To facilitate injection the kinematic viscosity of the additive concentrate is generally less than 300 $mm^2/s$ at −10° C., more preferably from 5 to 250 $mm^2/s$ at −10° C., and most preferably from 10 to 200 $mm^2/s$ at −10° C. To achieve this viscosity, an aromatic solvent such as toluene, xylene, a solvent mixture of $C_9$ aromatic hydrocarbon compounds, and the like is usually added to the concentrate.

In another embodiment, a fuel composition is provided comprising a major amount of a fuel and a minor amount of the foregoing fuel additive or fuel additive concentrate. The fuel used in the fuel composition of this invention is present in a major amount, e.g., an amount greater than about 50 wt. %, or greater than about 70 wt. %, or greater than about 80 wt. %, based on the total weight of the composition. The fuel is generally a petroleum hydrocarbon useful as a fuel, e.g., gasoline, for internal combustion engines. Such fuels typically comprise mixtures of hydrocarbons of various types, including straight and branched chain paraffins, olefins, aromatics and naphthenic hydrocarbons. These compositions are provided in a number of grades, such as unleaded and leaded gasoline, and are typically derived from petroleum crude oil by conventional refining and blending processes such as straight run distillation, thermal cracking, hydrocracking, catalytic cracking and various reforming processes. Gasoline may be defined as a mixture of liquid hydrocarbons or hydrocarbon-oxygenates having an initial boiling point in the range of about 20 to 60° C. and a final boiling point in the range of about 150 to 230° C., as determined by the ASTM D86 distillation method. The gasoline may contain small amounts, e.g., up to 20 wt. % and typically about 10 wt. %, of other combustibles such as alcohol, for example, methanol or ethanol, or other oxygenates, for example, methyl tert-butyl ether.

Other fuels which may be used include combustible fuels such as kerosene, diesel fuels, home heating fuels, jet fuels etc.

In general, the fuel additive or fuel additive concentrate can be present in the fuel composition in an amount of from about 50 parts per million weight (ppmw) to about 2 wt. %, based on the total weight of the fuel composition. In one embodiment, the fuel additive or fuel additive concentrate can be present in the fuel composition in an amount of from about 100 ppmw to about 1000 ppmw, based on the total weight of the fuel composition.

The fuel additive concentrate or fuel composition may also contain one or more other fuel additives typically contained in a fuel additive concentrate or fuel composition. These additional additives include, but are not limited to, detergents, cetane improvers, antioxidants, metal deactivators, dyes, markers, corrosion inhibitors, antistatic additives, drag reducing agents, demulsifiers, dehazers, anti-icing additives, lubricity additives, combustion improvers, anti-knock agents and the like, in known and conventional amounts. Generally, each of these additional components is included in the concentrate or fuel composition in an amount which corresponds to a treat level of from about 1 to about 500 ppm by weight in the finished fuel composition.

In general, the foregoing fuel composition can be used in both fuel-injected and non fuel-injected engines. For example, the fuel composition can be used in any type of internal combustion engine, such as two-stroke engines, four-stroke engines, and vehicle engines, e.g., automobile engines, diesel motorcycle engines, jet engines, marine engines, truck/bus engines, and the like. The engine is advantageously operated with the fuel composition in a low temperature environment. As one skilled in the art will readily appreciate, a low temperature environment is an environment which may correspond to temperatures below freezing, e.g., below from about 0° C. and below, or from about −5° C. and below, or from about −20° C. and below.

The following non-limiting examples are illustrative of the present invention.

Example 1

Preparation of Stock Solution without 2-Ethylhexanol

A stock solution was prepared in a 1-liter amber glass Boston round bottle by adding a mixture of amine-containing detergents (219.11 g, 45.10 wt. %), a $C_9$ aromatic solvent (262.78 g, 54.08 wt. %), and fuel additive concentration marker (3.97 g, 0.82 wt. %). The Boston bottle was then capped and briefly shaken by hand to afford a homogeneous fuel additive concentrate stock solution without 2-ethylhexanol.

Example 2

Preparation of a Stock Solution with 2-Ethylhexanol

A solution was made in a 1-liter amber glass Boston round bottle by adding adding a mixture of amine-containing detergents (146.48 g, 44.89 wt. %), a $C_9$ aromatic solvent (99.6 g, 30.52 wt. %), fuel additive concentration marker (2.85 g, 0.87 wt. %), and 2-ethylhexanol (77.39 g, 23.72 wt. %). The Boston bottle was then capped and briefly shaken by hand to afford a homogeneous fuel additive concentrate stock solution containing 2-ethylhexanol as the diluent.

Procedure for Cold Temperature Testing

A cold temperature test solution was made by blending a friction modifier with the appropriate stock solution of Examples 1 or 2 as set forth below in Examples 3 and 4 and Comparative Examples A and B. The amount of friction modifier was calculated and weighed out into a 30 mL clear glass vial such that 19.03 wt. % of friction modifier would be in the final test solution. The appropriate quantity of stock solution of Examples 1 or 2 was then added to the glass vial to bring to resultant solution to the final desired weight for the test solution. The vial was capped and shaken by hand until the solution was homogeneous and then placed in a cold well set at between 0° C. to −5° C. The test solutions were inspected visually each day to monitor solution clarity and sediment prevalence at set time intervals for 28 days according to a modified ASTM D4176 method utilizing a more detailed rating system as set forth in Table 1. At the end of each week, written observation were made using the rating system in Table 1. The prepared cold temperature test solution of Examples 3 and 4 and Comparative Examples A and B and results are set forth below in Table 2. Acceptable ratings are 0-2 for the fluid phase and 0-1 for sediment.

TABLE 1

COMPATABILITY RATING

| Fluid Phase | Sediment | Description |
|---|---|---|
| 0 | | Absolutely Bright |
| 1 | | Bright |
| 2 | | Slight Cloud |
| 3 | | Moderate Cloud |
| 4 | | Detectable Floc |
| 5 | | Heavy Floc |
| 6 | | Heavy Cloud |
| | 0 | No Sediment |
| | 1 | Very Slight Sediment |
| | 2 | Slight Sediment |
| | 3 | Heavy Sediment |

TABLE 2

| | Ex./Comp Ex. | | | | |
|---|---|---|---|---|---|
| Components (wt. %) | Ex. 3 | Ex. 4 | Ex. 5 | Comp. Ex. A | Comp. Ex. B |
| Weight percent ratio of sorbitan ester to glycerol ester in mixture | 50%:50% (1:1) | 0.05% to 99.95% (1:1999) | 0.1% to 99.90% (1:999) | N/A | N/A |
| Sorbitan monolaurate | 9.17 | — | — | — | — |

TABLE 2-continued

| Components (wt. %) | Ex./Comp Ex. | | | | |
|---|---|---|---|---|---|
| | Ex. 3 | Ex. 4 | Ex. 5 | Comp. Ex. A | Comp. Ex. B |
| Sorbitan tristearate | — | 0.95 | 1.9 | — | — |
| Glycerol monooleate | 9.16 | 18.08 | 17.13 | 19.03 | 19.00 |
| Mixture of amine-containing detergents | 36.83 | 36.52 | 36.52 | 36.41 | 36.37 |
| $C_9$ aromatic solvent | 44.17 | 24.76 | 24.76 | 43.79 | 24.72 |
| fuel additive concentration marker | 0.67 | 0.66 | 0.66 | 0.66 | 0.71 |
| 2-ethylhexanol | — | 19.03 | 19.03 | — | 19.21 |
| Rating on last passing day | 1/1 | 1/0 | 1/0 | 1/0 | 1/0 |
| Days Passing | >28 | 6 | 11 | 1 | 2 |
| Rating after failing | N/A | 4/3 | 4/3 | 2/4 | 1/2 |

As the data show in Table 2, Examples 3, 4, and 5 containing a mixture of the fatty acid sorbitan ester/glycerol monooleate friction modifier mixture (in amounts of 50 wt. %, 0.5 wt. %, and 0.1 wt. %, respectively, for the sorbitan ester, and 50 wt. %, 99.95 wt. %, and 99.99 wt. %, respectively, for the glycerol monooleate) significantly and unexpectedly passed a greater number of days at between 0° C. to −5° C. than Comparative Examples A and B containing only a glycerol monooleate.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A fuel additive consisting of a mixture of (a) one or more fully saturated fatty acid sorbitan esters and (b) one or more fatty acid monoesters of a polyol, wherein the one or more fully saturated fatty acid sorbitan esters are present in an amount of 0.05 wt. % to 1 wt. %, based on the total weight of the fuel additive, and the one or more fatty acid monoesters of a polyol present in an amount of 99.95 wt. % to 99 wt. % based on the total weight of the fuel additive.

2. The fuel additive of claim 1, wherein the one or more fully saturated fatty acid sorbitan esters are $C_4$ to $C_{28}$ fully saturated fatty acid sorbitan esters and the one or more fatty acid monoesters of a polyol are $C_4$ to $C_{28}$ fatty acid glycerol monoesters.

3. The fuel additive of claim 1, wherein the one or more fatty acid monoesters of a polyol are unsaturated fatty acid glycerol monoesters.

4. The fuel additive of claim 1, wherein the one or more fully saturated fatty acid sorbitan esters are fully saturated $C_4$ to $C_{28}$ fatty acid sorbitan esters and the one or more fatty acid monoesters of a polyol are fully unsaturated $C_4$ to $C_{28}$ fatty acid glycerol monoesters.

5. The fuel additive of claim 1, wherein the one or more fully saturated fatty acid sorbitan esters are present in an amount of 0.1 wt. % to 1 wt. %, based on the weight of the fuel additive, and the one or more fatty acid monoesters of a polyol are present in an amount of 99.90 wt. % to 99 wt. %, based on the weight of the fuel additive.

6. A fuel additive concentrate consisting of from 5 to 50 wt. % of (a) a fuel additive containing a mixture of (i) one or more fully saturated fatty acid sorbitan esters and (ii) one or more fatty acid monoesters of a polyol, wherein the one or more fatty acid sorbitan esters are present in an amount of 0.05 wt. % to 1 wt. %, based on the total weight of the fuel additive, and the one or more fatty acid monoesters of a polyol present in an amount of 99.95 wt. % to 99 wt. %, based on the total weight of the fuel additive, (b) 50 to 95% by weight of a fuel carrier fluid, wherein the fuel additive concentrate is a solution, and (c) optionally, one or more fuel additives selected from the group consisting of a detergent, a cetane improver, an antioxidant, a metal deactivator, a dye, a marker, a corrosion inhibitor, an antistatic additive, a drag reducing agent, a demulsifier, a dehazer, an anti-icing additive, a lubricity additive a combustion improver, and an antiknock agent.

7. The fuel additive concentrate of claim 6, wherein the one or more fully saturated fatty acid sorbitan esters are $C_4$ to $C_{28}$ fully saturated fatty acid sorbitan esters and the one or more fatty acid monoesters of a polyol are $C_4$ to $C_{28}$ fatty acid glycerol monoesters.

8. The fuel additive concentrate of claim 6, wherein the one or more fatty acid monoesters of a polyol are unsaturated fatty acid glycerol monoesters.

9. The fuel additive concentrate of claim 6, wherein the one or more fully saturated fatty acid sorbitan esters are present in an amount of 0.1 wt. % to 1 wt. %, based on the weight of the fuel additive, and the one or more fatty acid monoesters of a polyol are present in an amount of 99.9 wt. % to 99 wt. %, based on the weight of the fuel additive.

10. A fuel composition consisting of (a) a major amount of a fuel, and (b) a minor amount of a fuel additive containing a mixture of (i) one or more fully saturated fatty acid sorbitan esters, (ii) one or more fatty acid monoesters of a polyol, wherein the one or more fully saturated fatty acid sorbitan esters are present in an amount of 0.05 wt. % to 1 wt. %, based on the total weight of the fuel additive, and the one or more fatty acid monoesters of a polyol present in an amount of 99.95 wt. % to 99 wt. %, based on the weight of the fuel additive, (iii) optionally, a fuel carrier fluid to form a fuel concentrate solution having from 5 to 50 wt. % of the fuel additive and 50 to 95 wt. % of a fuel carrier fluid; and (iv) optionally, one or more fuel additives selected from the group consisting of a detergent, a cetane improver, an antioxidant, a metal deactivator, a dye, a marker, a corrosion inhibitor, an antistatic additive, a drag reducing agent, a demulsifier, a dehazer, an anti-icing additive, a lubricity additive, a combustion improver, and an antiknock agent.

11. The fuel composition of claim 10, wherein the fuel is gasoline.

12. The fuel composition of claim 10, wherein the one or more fully saturated fatty acid sorbitan esters are $C_4$ to $C_{28}$ fully saturated fatty acid sorbitan esters and the one or more fatty acid monoesters of a polyol are $C_4$ to $C_{28}$ fatty acid glycerol monoesters.

13. The fuel composition of claim 10, wherein the one or more fatty acid monoesters of a polyol are unsaturated fatty acid glycerol monoesters.

14. The fuel composition of claim 10, wherein the fuel additive is present in an amount of 50 ppmw to 2 wt. %, based on the total weight of the fuel composition.

15. A method to improve the low temperature stability of a fatty acid monoester of a polyol in a fuel, the method comprising (a) providing the fuel additive of claim 1, and (b) combining the fuel additive with a major amount of a fuel.

16. A method comprising operating an internal combustion engine with the fuel composition of claim 12.

17. A method comprising operating an internal combustion engine with the fuel composition of claim 10.

18. The method of claim 15, wherein the fuel additive further includes a fuel carrier fluid to form a fuel concentrate solution which comprises from 5 to 50 wt. % of the fuel additive and 50 to about 95 wt. % of a fuel carrier fluid.

* * * * *